US005612678A

United States Patent [19]

Shibata

[11] Patent Number: 5,612,678

[45] Date of Patent: Mar. 18, 1997

[54] FIRE DETECTOR AND DEVICE FOR DETACHING BODY THEREOF

[75] Inventor: Masao Shibata, Sagamihara, Japan

[73] Assignee: Hochiki Kabushiki Kaisha, Tokyo, Japan

[21] Appl. No.: 405,534

[22] Filed: Mar. 16, 1995

[30] Foreign Application Priority Data

Apr. 14, 1994 [JP] Japan ..... 6-075548

[51] Int. Cl.[6] ..... G08B 27/00

[52] U.S. Cl. ..... 340/628; 340/693; 220/323; 220/324; 220/326; 220/315

[58] Field of Search ..... 340/628, 629, 340/630, 693; 220/323, 324, 326, 315, 701

[56] References Cited

U.S. PATENT DOCUMENTS

| | | | |
|---|---|---|---|
| 1,220,873 | 3/1917 | Myers | 220/324 |
| 3,503,643 | 3/1970 | Alfaro | 220/315 |
| 4,315,594 | 2/1982 | Niederost | 340/693 |
| 4,410,102 | 10/1983 | Lutzker | 220/323 |
| 4,724,430 | 2/1988 | Igarashi | 340/693 |

FOREIGN PATENT DOCUMENTS

| | | |
|---|---|---|
| 0567820A1 | 8/1993 | European Pat. Off. . |
| 2181178 | 4/1987 | United Kingdom . |

*Primary Examiner*—Jeffery Hofsass
*Assistant Examiner*—Julie B. Lieu
*Attorney, Agent, or Firm*—Lackenbach Siegel et al.

[57] ABSTRACT

A fire detector consisting of a body and a base. An inner wall part is provided in a circumferential wall of the body in such a manner that the inner wall part can be cut away therefrom. Further, an engaging member abutting on the inner wall part is provided in the base. If it is unnecessary to lock the body to the base, the inner wall part is not cut away therefrom. In contrast, if it is necessary to lock the body to the base, the inner wall part is cut away therefrom. Thereby, the engaging member 12 can be fitted into a recess portion formed on the circumferential wall by cutting away the inner wall part therefrom. If the body is pushed against the base, a leading end of the engaging member is pushed up by the top surface of the circumferential wall. When the body being in such a state is turned in the circumferential or clockwise direction thereof to a fixing position at which the body is fixed, the leading end is fitted into the recess portion and moves downwardly. Even if the body being in this state is turned to an initial position thereof and is then detached therefrom, the leading end abuts the recess portion in the circumferential direction thereof and thus comes to be unable to be turned. Namely, the body is locked to the base thereof. Thereby, it can be selected according to the specifications of the fire detector as to whether or not the body is to be locked to the base. Consequently, the fire detector of the invention can be formed at a low cost regardless of whether or not the body is to be locked to the base of the fire detector.

3 Claims, 7 Drawing Sheets

FIG.7
FIG.7A
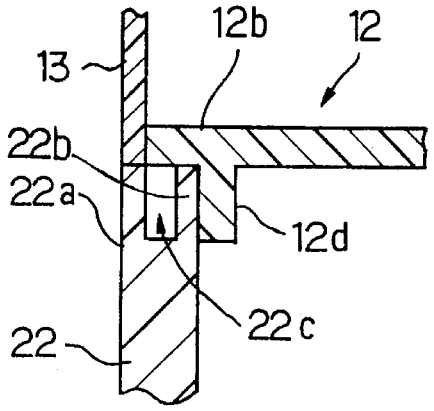
FIG.7B
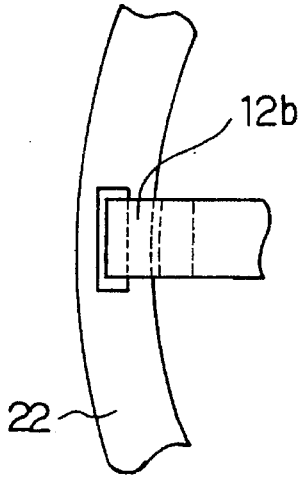
FIG.8
FIG.8A
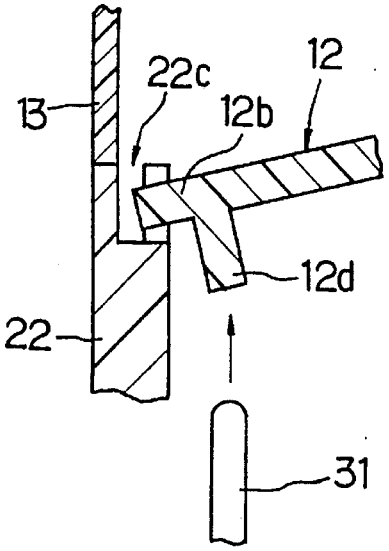
FIG.8B
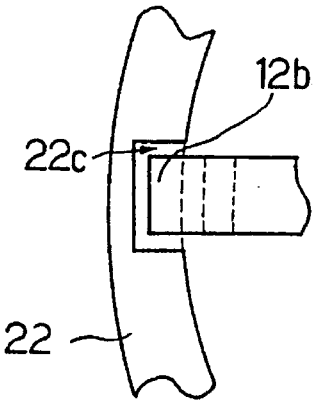

PRIOR ART

FIRE DETECTOR AND DEVICE FOR DETACHING BODY THEREOF

BACKGROUND OF THE INVENTION

1. Field of the Invention

This invention relates to a fire detector, the body of which is attached to a base thereof. Further, this invention relates to a device for detaching the body of a fire detector therefrom. More particularly, this invention relates to a locking structure for locking the body of a fire detector to the base thereof, which can be selectively locked thereto according to specifications thereof and can not be easily released therefrom by any person other than persons concerned but can be easily released therefrom by a person concerned. Moreover, this invention relates to a device for releasing the body of a fire detector, which is locked to the base thereof through such a locking structure.

2. Description of the Related Art

Generally, a fire detector is composed of a base and a body thereof. The base of the detector is fixed to the ceiling of a room with screws or the like. Further, the body of the detector is detachably mounted to this base with metal fitting parts. Meanwhile, in the case of a fire detector having such a configuration, the body thereof can be detached from the base thereof. Thus, the body thereof is sometimes stolen. Moreover, in the case of an ionization smoke detector, a radiation source is provided therein. Thus, if the body thereof is detached therefrom, radiation leakage may put a human body in danger. Therefore, the body of the fire detector is locked to the base thereof by securing the body to the base with screws or by forming the body and the base separately from each other and further engaging the base with the base, with the intention of preventing the body from being stolen, or of preventing a human body from being put into danger.

Hereinafter, conventional structures each for locking the body of a fire detector to the base thereof as disclosed in the Japanese Utility Model Public Disclosure Nos. 143690/1990 and 41393/1991 Official Gazettes will be described.

For example, the Japanese Utility Model Public Disclosure No. 143690/1990 Official Gazette discloses a locking structure for locking the body of a fire detector to the base thereof, in which an engaging projection 101 of a movable engaging portion 103 is fitted into a notched recess portion 102 as illustrated in the prior art FIGS. 10 and 11, so that the body and the base get into a locked state. Moreover, the Japanese Utility Model Public Disclosure No. 41393/1991 Official Gazette discloses a similar locking structure for locking the body of a fire detector to the base thereof.

Thus, in the case of the conventional fire detector, the body of the detector is locked to the base thereof by securing the body to the base with screws or by forming engaging members in the body and the base thereof. Conversely, in some cases, for instance, in case where the public peace is maintained at the installation location of the fire detector, the fire detector does not require such a locking structure. However, in this case, there is caused a problem that fire detectors each having the locking structure should be designed and manufactured in specifications, aside from fire detectors which do not require the locking structures, and thus the price of the manufactured detector becomes high.

Further, even in the case of the fire detector having the locking structure disclosed in the Japanese Utility Model Public Disclosure No. 143690/1990 and so on, situations in which the locking structure is not required by the detector are ignored. Therefore, the specifications concerning such a locking can not be freely altered. Especially, there is a case where the fire detector is installed by changing only a part of the specifications concerning the body thereof but without changing those concerning the base thereof. Thus, the aforementioned locking structure has a problem in that such a locking structure can not be changed into a non-locking structure. Moreover, the aforementioned locking structure is provided in an outer portion of the peripheral part of the body of the detector, as illustrated in FIG. 10. As a result, the locking structure can be easily unlocked from the outside of the detector. Consequently, the conventional fire detector has a problem in that such a locking structure is ineffective in preventing a theft.

Additionally, the conventional fire detector has another problem in that if the locked fire detector is mounted on a high ceiling, it is difficult for a person concerned to remove the body of the detector from the base thereof. The present invention is accomplished to resolve the problems of the conventional fire detector.

SUMMARY OF THE INVENTION

An object of the present invention is to provide a fire detector which can select according to specifications thereof whether or not the body thereof is locked to the base thereof and which can be manufactured at a low cost.

Further, another object of the present invention is to provide a device for detaching the body of a fire detector from the base thereof, by which any person concerned can easily detach the body thereof from the base thereof.

To achieve the foregoing object, in accordance with an aspect of the present invention, there is provided a fire detector consisting of a body and a base, wherein the body is attached to the base through metal fitting parts respectively provided in the body and the base by turning the body to a fixing position, at which the body is fixed to the base, while the body is being pushed against the base, and by then fitting the metal fitting parts provided in the body to the metal fitting parts provided in the base, wherein the body is unable to move downwardly from the base during the metal fitting parts provided in the body are fitted to the metal fitting parts provided in the base. The fire detector further comprises a flexible engaging member vertically movably provided on the base and a wall portion provided on the body. The engaging member is adapted to move upwardly by being pushed by the body when the body is pushed against the base. The top surface of the wall portion is adapted to abut on the engaging member when the body is pushed against the base. Further, parts of the wall portions, on which the engaging member abuts when the body is fixed at the fixing position, can be cut away therefrom. Moreover, recess portions, with which the engaging member is engaged, are formed when the parts of the wall portion are cut away therefrom. When the engaging member is fitted to the recess portion in case where the body is turned to the fixing position while the body is pushed against the base, the body is restrained from being turned. In case where the parts of the wall portion are not cut away therefrom, the engaging member is adapted to get on the wall portion at the fixing position and the body is not restrained from being turned.

In the case where the body of the detector having such a configuration is locked to the base thereof, the parts of the wall portion provided on the body are cut away therefrom. Therefore, when the body is turned to the fixing position while the body is pushed against the base, the engaging member moves downwardly and is fitted into the recess portion. Thereby, the body of the detector is restrained from being turned. On the other hand, when the body of the detector is fixed by means of the metal fitting parts, the body is unable to move downwardly from the base. Thus the body is locked to the base. In contrast, in the case where the body of the detector is not locked to the base thereof, the parts of the wall portion are not cut away therefrom. Namely, when the body of the detector is turned to the fixing position while the body is pushed against the base, the body is not restrained from being turned. Therefore, both the body and the base of the detector can be formed in such a manner as to have a same structure in both of the cases where the locking of the body to the base is performed and where such a locking is not performed. Consequently, the fire detector can be manufactured at a low cost. Moreover, by cutting away the parts of the wall portion of the body of the fire detector or not cutting away the parts of the wall portion, it can be selected according to specifications whether or not the body of the fire detector is to be locked to the base thereof.

Further, in the case of the fire detector of the present invention, preferably, drain holes are formed in the body at positions each corresponding to a position at which the engaging member is placed when the body is at the fixing position.

Thus, in the case of the fire detector of the present invention, the drain holes bored in the body thereof also serve as detaching holes. Moreover, the body can be released from the base by inserting pins into the drain or detaching holes. Consequently, a fire detector, from which the body thereof can be easily detached by a person concerned, is realized.

Furthermore, a detaching device for detaching the body of such a fire detector of the present invention therefrom is provided with pins, each of which is inserted into the drain holes bored in the body of the detector so as to abut the engaging member thereof and is operative to move the engaging member upwardly so as to release the engaging member from the recess portion.

Thereby, a detaching device, by which the body of the detector can be easily detached therefrom, is realized.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIGS. 7(*a*) and 7(*b*) are diagrams for illustrating another example of a locking structure according to the present invention in a state in which the body of the fire detector is not locked to the base thereof;

FIGS. 8(*a*) and 8(*b*) are diagrams for illustrating a state of the locking structure of FIGS. 7(*a*) and 7(*b*), in which the body of the fire detector is locked to the base thereof, and for illustrating a state of the locking structure, in which the body having been locked to the base thereof is released therefrom;

DETAILED DESCRIPTION OF THE PREFERRED EMBODIMENTS

Figure 1:
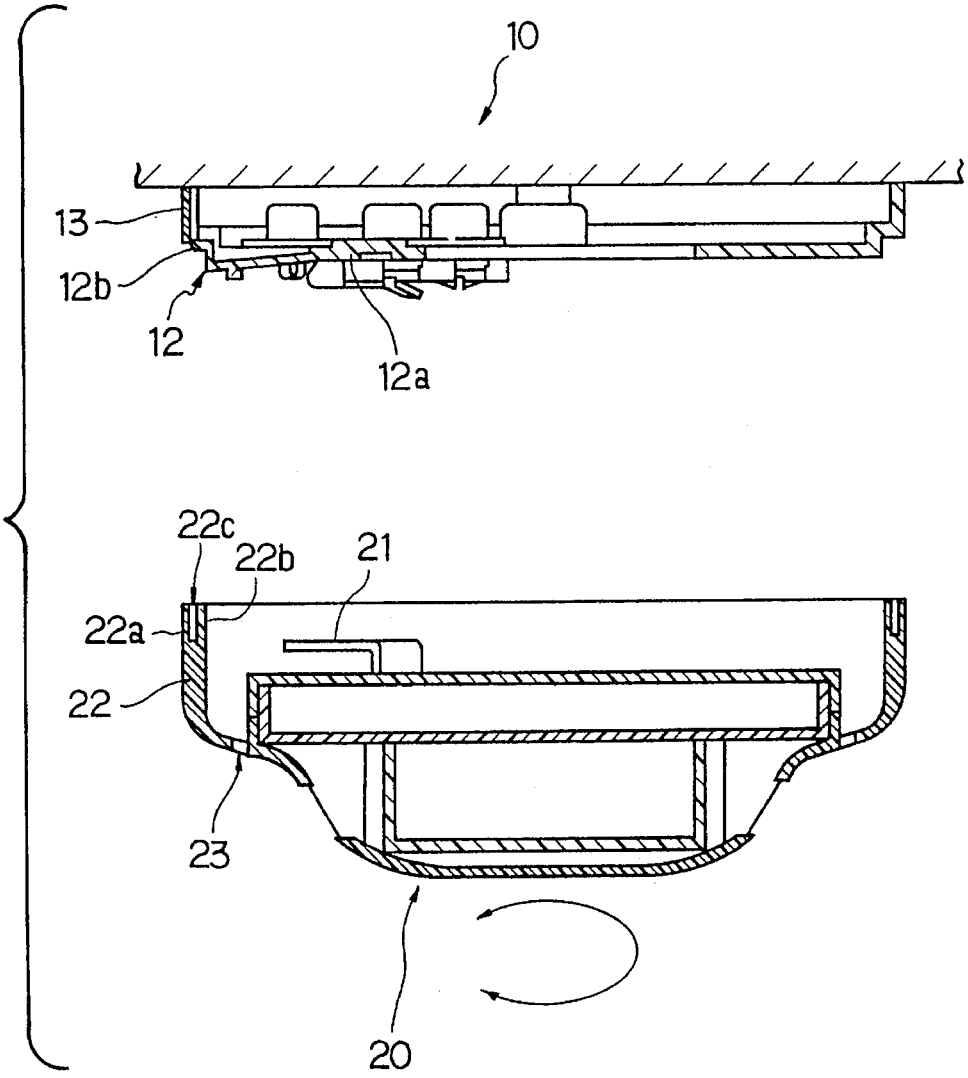
FIG. 1 is a side view of the body and the base of a fire detector embodying the present invention.
Figure 2:
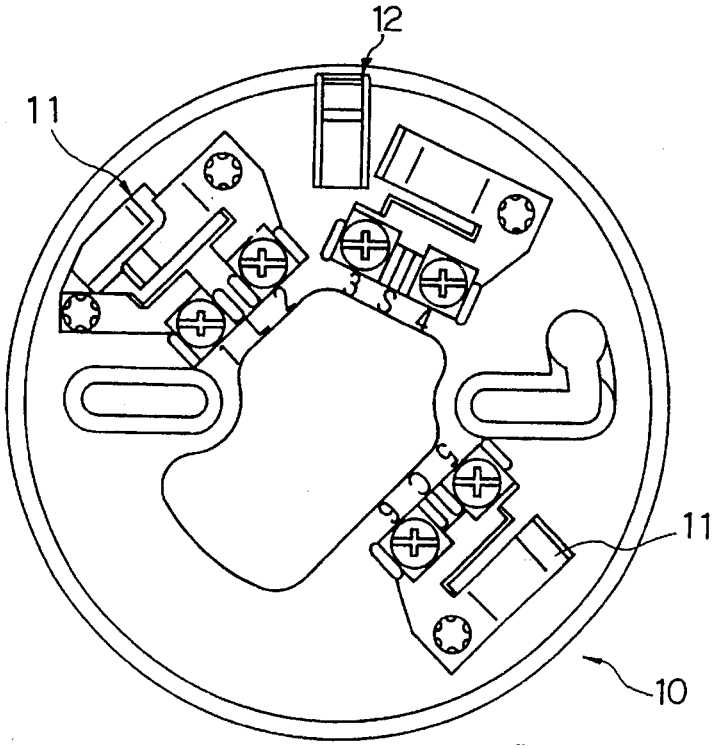
FIG. 2 is a bottom view of the base of FIG. 1.

Hereinafter, the preferred embodiments of the present invention will be described in detail by referring to the accompanying drawings.

FIG. 1 to FIG. 4 illustrate a fire detector which is an embodiment of the present invention. The fire detector of this embodiment consists of a base 10 and a detector body 20. The base 10 is secured to the ceiling of a room with screws or the like. Further, metal fitting parts 11 and 21, each of which serves as an electric contact, are attached to both the base 10 and the body 20 of the detector, respectively, so as to mount the body 20 thereof to the base 10 thereof detachably. Both the base 10 and the detector body 20 is made of, for example, plastics and is thin and nearly cylindrical in form.

The metal fitting parts 11 are fitted into the corresponding metal fitting parts 21, respectively, by first engaging the body 20 with the base 10 in the circumferential direction thereof and then turning the body 20 clockwise with respect to the base 10. Further, when the body 20 is thus fitted into the base 10, the body 20 is unable to move downwardly and thus does not fall downwardly from the base 10. Moreover, this embodiment is formed in such a manner that when turning the body 20 fitted into the base 10 counterclockwise, the body 20 is released from the base 10.

Therefore, in the case of this detector, the body 20 thereof can be locked to the base 10 thereof by making the body 20 unable to turn from the position at which the body 20 is firmly attached thereto.

An engaging member 12 serving as a locking mechanism is integral with the base 10 in such a manner that the longitudinal direction of the engaging member 12 is the direction of a radius of the base 10. This engaging member 12 has an end portion 12*a* thereof connected to an inner part in the direction along the diameter of the base 10. Further, a leading end 12*b* of the engaging member 12 is a free end and is movable or shiftable in such as manner as to be able to move vertically in the inside of an outer circumferential wall 13 of the base 10. Thus, the engaging member is not bent when abutting against the top of the wall of the body of the smoke detector. Moreover, this leading end 12*b* is formed in such fashion as to protrude from the bottom surface of the base while being not pushed up from underneath.

Figure 3:
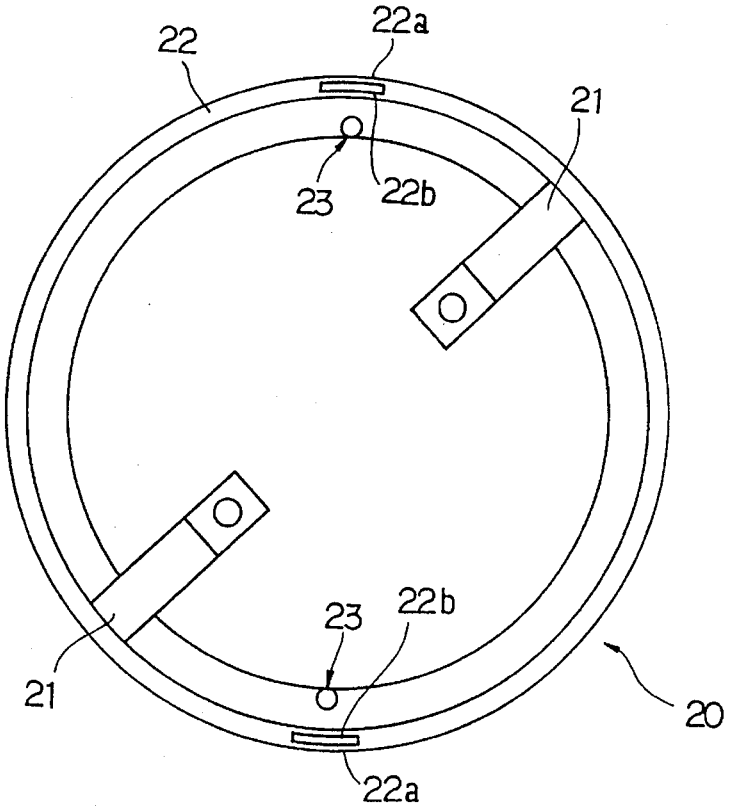
FIG. 3 is a top view of the body of the fire detector of FIG. 1.

In contrast with this, a circumferential wall 22 of the body 20 of the detector has double-wall parts 22*a* and 22*b* on which the engaging member 12 of the base 10 abuts when the body 20 of the detector is fixed to the base 10. A recess portion 22*c* opening upward is formed by the double-wall parts 22*a* and 22*b*. Further, the inner wall parts 22*b* are formed in such a way as to be able to be easily cut away by jigs or by hand. Conversely, in the case where the inner wall parts are not cut away, the engaging member 12 is formed in such a manner as to have a thickness and strength to the extent sufficient to be able to push up the leading end or edge 12*b* of the engaging member 12 when the body 20 of the detector is attached to the base 10 thereof. Incidentally, in the case of this embodiment, for the purpose of facilitating the attaching of the body 20 of the detector, two sets of the double-wall parts 22*a* and 22*b* and the recess portion 22*c* are provided in the body 20 of the detector in such a manner that the two sets are apart from each other 180 degrees as illustrated in FIG. 3. However, only one set of the double-wall parts 22*a* and 22*b* and the recess portion 22*c* may be provided in the body 20 of the detector.

Figure 4:
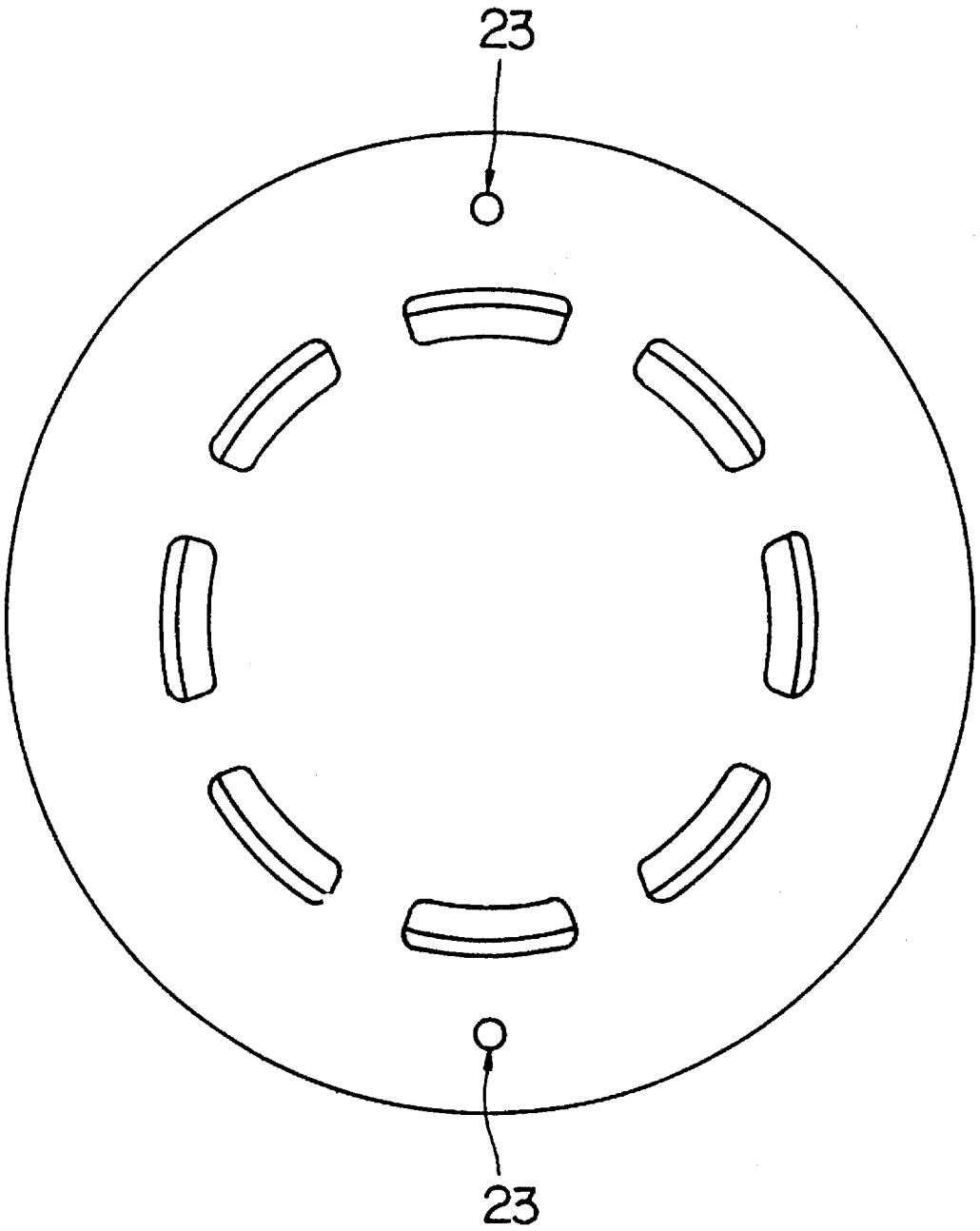
FIG. 4 is a bottom view of the body of the fire detector of FIG. 1.

Furthermore, in the case of this embodiment, holes 23 are formed in the floor wall of the body 20 of the detector as drain holes as illustrated in detail in FIG. 4. The holes 23 also serve as insertion holes, through which pins 31 of a device 30 (to be described later) for detaching the body of the detector therefrom are inserted to push up the leading ends 12*b* of the engaging members 12 of the base 10. Naturally, the holes 23 are formed at such positions that the leading ends 12*b* of the engaging members 12 can be pushed up, correspondingly to a fixing position at which the body 20 of the detector is fixed.

Figure 5A:
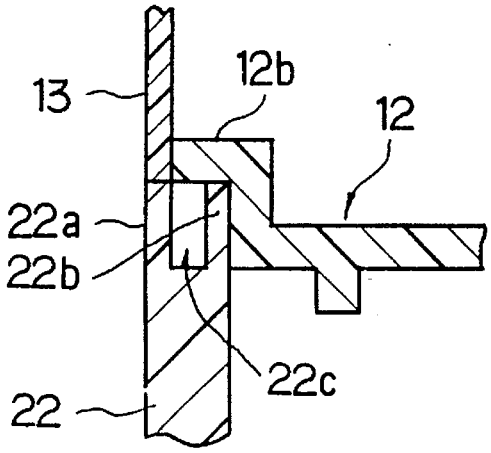
FIGS. 5(*a*) and 5(*b*) are diagrams for illustrating a state of the fire detector of FIG. 1, in which the body thereof is not locked to the base thereof.
Figure 5B:
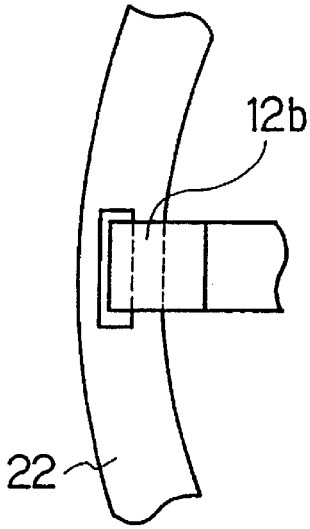

In the case where it is unnecessary to lock the body 20 of the detector having such a configuration to the base 10 thereof, the body 20 is attached to the base 10 without cutting away the inner wall parts 22*b* of the circumferential wall 22 of the body 20 thereof. Then, when the body 20 of the detector is pushed against the base 10 thereof, the leading end 12*b* of the engaging member 12 of the base 10 thereof is pushed up to the top surface of the circumferential wall 22 of the body 20 thereof. Even if the body 20 of the detector is turned in the circumferential direction thereof to the fixing position thereof, the leading end 12*b* of the engaging member 12 is not fitted into the recess portion 22*c* owing to the presence of the inner wall part 22*b* as illustrated in FIGS. 5(*a*) and 5(*b*). Consequently, the body 20 of the detector is not locked to the base 10 thereof.

Figure 6A:
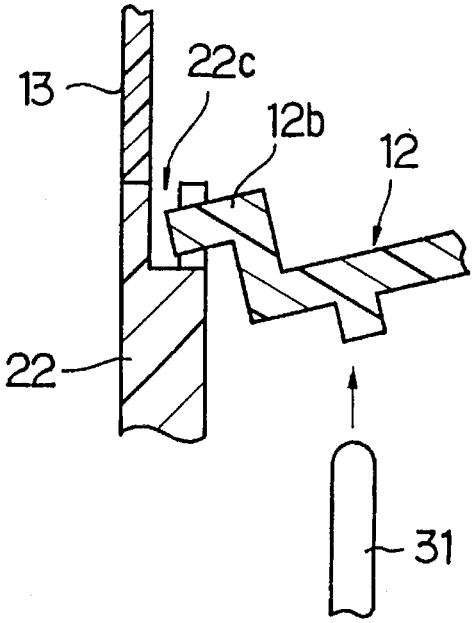
FIGS. 6(*a*) and 6(*b*) are diagrams for illustrating a state of the fire detector of FIG. 1, in which the body thereof is locked to the base thereof, and for illustrating a state thereof, in which the body having been locked to the base thereof is released therefrom.
Figure 6B:
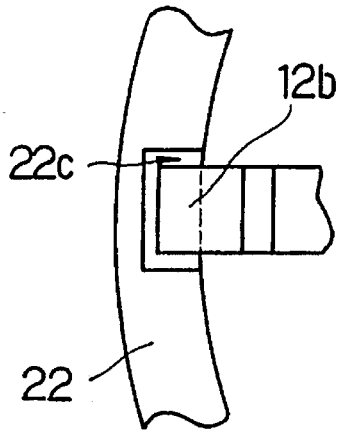
Figure 9:
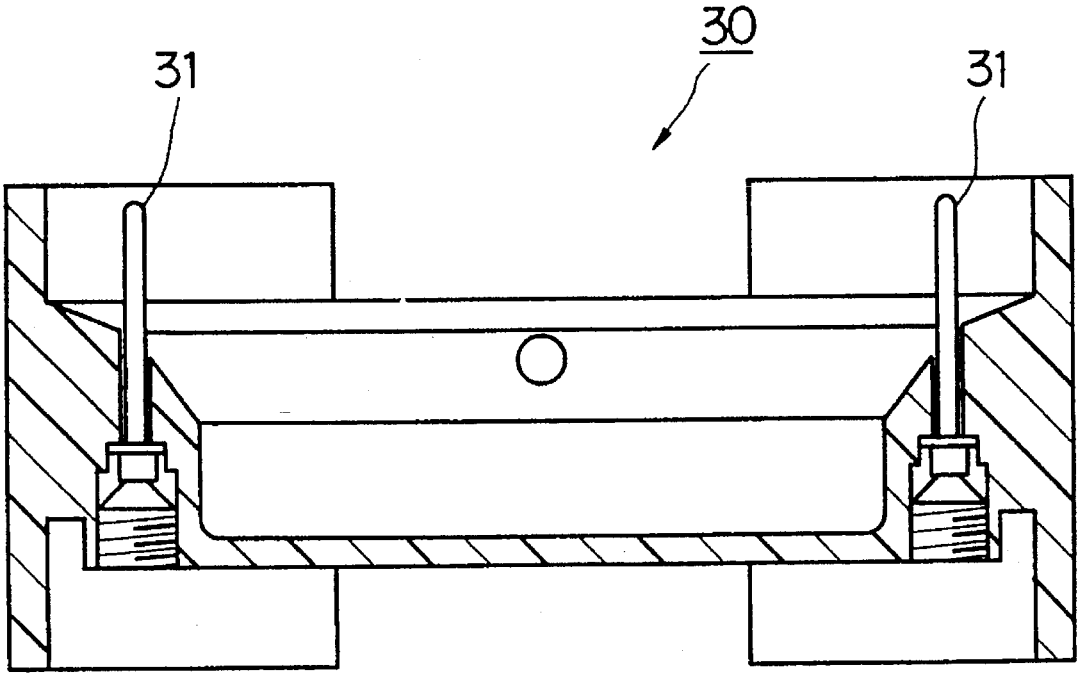
FIG. 9 is a side view of a device for detaching the body of a fire detector embodying the present invention therefrom.
Figure 10:
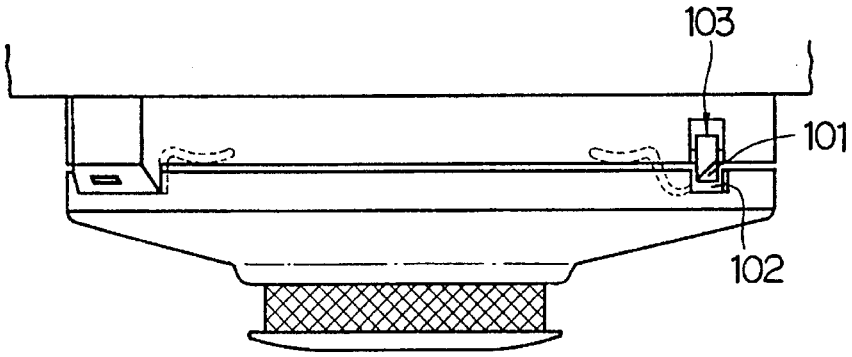
FIG. 10 is a side view of the conventional locking structure of a fire detector.
Figure 11:
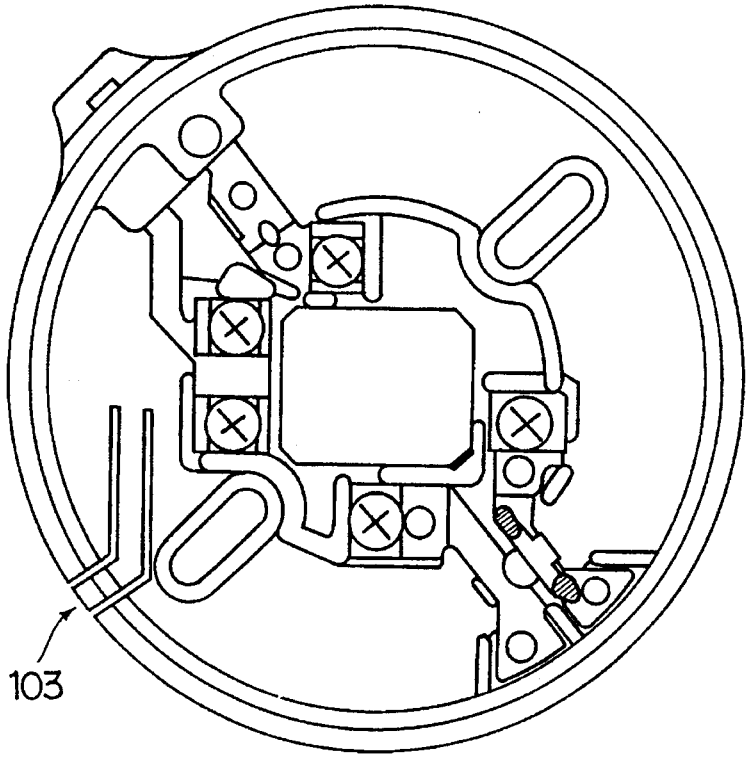
PRIOR ART FIG.11
FIG. 11 is a bottom view of the base of the locking structure of FIG. 10.

In contrast with this, in the case where it is necessary to lock the body 20 of the detector to the base 10 thereof, the inner wall parts 22*b* of the circumferential wall 22 of the body 20 thereof are cut away therefrom. At that time, the recess portion 22*c* is changed into a stair-like portion adjacent to the circumferential wall 22, namely, into a form to which the engaging member 12 can be fitted. In this case, at first, the leading end 12*b* of the engaging member 12 of the base 10 is pushed up by the top surface of the circumferential wall 22 of the body 20 of the detector when the body 20 thereof is pushed against the base 10 thereof, similarly as in the aforementioned case. However, in the case where the inner wall parts 22*b* are cut away therefrom, the leading end 12*b* of the engaging member 12 is fitted into the recess portion 22*c* and moves downwardly, as illustrated in FIGS. 6(*a*) and 6(*b*), when the body 20 of the detector being in such a state is turned in the circumferential thereof to the fixing position thereof. Therefore, even if turning the body 20 of the detector to the initial position thereof so as to detach the body 20 thereof, the leading end 12*b* of the engaging member 12 abuts on the recess portion 22*c* in the circumferential direction thereof and thus the body 20 thereof is unable to be turned. Consequently, the body 20 of the detector is locked to the base 10 thereof.

As described above, even in the case where the locking of the body 20 of the detector to the base 10 thereof is necessary, the body 20 and the base 10 thereof can be formed in such a way as to have the same structure as in the case where such a locking is unnecessary.

FIGS. 7(*a*), 7(*b*), 8(*a*) and 8(*b*) are diagrams for illustrating another embodiment of the locking structure. In the case of this embodiment, the shape of the leading end 12*b* of the engaging member 12 is simplified. Differently from the case of the configuration of FIGS. 5(*a*), 5(*b*), 6(*a*) and 6(*b*) in which the leading end 12*b* is shaped like a stair, the leading end 12*b* of this embodiment is formed like a flat plate, which is continuous with the root portion of the engaging member 12. Further, in the case of this embodiment, an abutting piece 12*d* is provided as a common portion to be brought into abutting engagement with the inner surface of the wall 22*b* and to be pushed up by the pin 31 of the device 30 (to be described later) for detaching the body of the detector therefrom. Therefore, this embodiment of the present invention has an advantage in that the structure of a mold for forming the engaging member 12 can be further simplified.

Next, the device 30 for detaching the body of the detector therefrom will be described by referring to FIGS. 6(*a*), 6(*b*) and 9. First, as described above, the holes 23 are bored in the floor wall of the body 20 of the detector. On the other hand, the pins 31 are provided in the device 30 for detaching the body of the detector therefrom. Further, the body 20 of the detector having been locked to the base 10 is released therefrom by inserting the pins 31 into the holes 23 so as to push up the leading end 12*b* of the engaging member 12 of the base 10. Moreover, this device 31 for detaching the body of the detector therefrom is shaped into a form which covers the body 20 of the detector in such a manner as to facilitate the detaching of the body 20 of the detector.

Furthermore, for example, a stick is attached to the device 30 for detaching the body 20 of the detector therefrom. Thereby, even in the case where the detector is mounted at a high place, the body 20 of the detector can be easily detached therefrom by a person concerned. Moreover, ordinary persons do not notice that the holes 23 are also used to detach the body 20 of the detector. Additionally, ordinary persons can not easily find out a method for releasing the body thereof locked to the base thereof. Therefore, in accordance with the present invention, any person concerned can easily detach the body 20 of the detector by use of the device 31 for detaching the body 20 therefrom, while ordinary persons can not detach the body 20 therefrom. Consequently, the body of the detector can be prevented from being stolen.

Although the preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A fire detector having a body and a base, the body being attachable to the base by means of metal fitting parts respectively provided in the body and the base by turning the body, while the body is being pushed against the base, to a fixing position at which the body is fixed to the base, whereby the metal fitting parts provided in the body are fitted to the metal fitting parts provided in the base, the body being unable to move downwardly away from the base when the metal fitting parts provided in the body are so fitted to the metal fitting parts provided in the base, the fire detector additionally comprising:

a vertically movable-shiftable engaging member provided on the base and adapted to be deflected upwardly by being pushed by the body when the body is pushed against the base; and a wall portion provided on the body, a top surface of the wall portion being adapted to abut on the engaging member when the body is pushed against the base, at least one part of the wall portion on which the engaging member abuts when the body is located at the fixing position, being adapted to be cut away from the wall portion, whereby at least one recess portion, with which the engaging member is engaged is formed when said at least one part of the wall portion is cut away therefrom, wherein when the engaging member engages with the recess/portion in the case where the body is turned to the fixing position while the body is pushed against the base, the body is restrained from being turned back to release it from the base, and wherein in the case where said at least one part of the wall portion is not cut away therefrom, the engaging member is adapted to lie on wall portion at the fixing position such that the body is not restrained from being turned back to release it from the base, and wherein at least one drain and insertion hole is formed in the body at least one position each corresponding to a position at which the engaging member is placed when the body is at the fixing position; whereby said at lest one drain and insertion hole is used in detaching said body from said base of said fire detector.

2. A fire detector as claimed in claim 1, wherein said wall portion of the body is cylindrical and there are two said parts of the wall which are cut away, and which are disposed at diametrically opposite positions on the cylindrical wall portion.

3. A device for detaching a body of a fire detector therefrom, the fire detector having the body and a base, the body being attachable to the base through metal fitting parts respectively provided in the body and the base by turning the body relative to the base while the body is being pushed against the base, to a fixing position, at which the body is fixed to the base, and by fitting the metal fitting parts provided in the body to the metal fitting parts provided in the base, the body being unable to move downwardly from the base when the metal fitting parts provided in the body are fitted to the metal fitting parts provided in the base, the fire detector further having a vertically movable-shiftable engaging member provided on the base, the engaging member being adapted to flex upwardly by being pushed by the body when the body is pushed against the base and a wall portion provided on the body, a top surface of the wall portion being adapted to abut on the engaging member when the body is pushed against the base, at least one part of the wall portion, on which the engaging member abuts when the body is locked at the fixing position, being adapted to be cut away from the wall portion, whereby at least one recess portion, with which the engaging member is engaged is formed when said at least one part of the wall portion is cut away therefrom, wherein when the engaging member engages with the recess portion in the case where the body is turned to the fixing position while the body is pushed against the base, the body is restrained from being turned back to release it from the base, and wherein in the case where said at least one case where part of the wall portion is not cut away therefrom, the engaging member is adapted to lie on the wall portion at the fixing position such that the body is not restrained from being turned back to release it from the base, wherein at least one drain and invention hole is formed in the body at at least one position each corresponding to a position at which the engaging-member is placed when the body is at the fixing position, and the device for detaching said body of the fire detector therefrom further having:

at least one pin adapted to be inserted into the said at least one drain and insertion hole so as to abut the engaging member, with each of said at lest one pin being operative to move the engaging member upwardly so as to release the engaging member from the recess portion.

* * * * *